US008677862B2

(12) United States Patent
Backlund

(10) Patent No.: US 8,677,862 B2
(45) Date of Patent: Mar. 25, 2014

(54) TWO HANDED PORTABLE POWER WRENCH

(75) Inventor: Jeffrey Backlund, Woodbury, MN (US)

(73) Assignee: Torqbuddy LLC, Woodbury, MN (US)

( * ) Notice: Subject to any disclaimer, the term of this patent is extended or adjusted under 35 U.S.C. 154(b) by 370 days.

(21) Appl. No.: 13/117,007

(22) Filed: May 26, 2011

(65) Prior Publication Data

US 2012/0297932 A1 Nov. 29, 2012

(51) Int. Cl.
*B25B 13/00* (2006.01)
*B25B 17/00* (2006.01)

(52) U.S. Cl.
USPC ..... 81/54; 81/57.3

(58) Field of Classification Search
USPC ..... 81/54, 57.3, 57.11, 57.13, 58, 60
See application file for complete search history.

(56) References Cited

U.S. PATENT DOCUMENTS

| | | | | |
|---|---|---|---|---|
| 1,194,197 | A | 8/1916 | Jones | |
| 3,768,775 | A | 10/1973 | Archer | |
| 3,939,924 | A | 2/1976 | Grabovac | |
| 4,541,313 | A * | 9/1985 | Wise | 81/478 |
| 4,621,789 | A | 11/1986 | Fukamachi | |
| 4,729,269 | A | 3/1988 | Killian | |
| 4,815,345 | A | 3/1989 | Radice | |
| 5,060,343 | A | 10/1991 | Nisenbaum | |
| 5,125,130 | A | 6/1992 | Stanish | |
| 5,330,014 | A * | 7/1994 | Wagner | 175/18 |
| 5,381,996 | A | 1/1995 | Arnemann et al. | |
| 5,499,852 | A | 3/1996 | Seigendall | |
| 5,921,157 | A * | 7/1999 | Smith et al. | 81/58.1 |
| 5,974,913 | A | 11/1999 | Von Rotz et al. | |
| 6,170,801 | B1 | 1/2001 | Powell et al. | |
| 6,240,809 | B1 | 6/2001 | Sasarak | |
| 6,282,989 | B1 | 9/2001 | Sorter | |
| 6,601,887 | B2 | 8/2003 | Graves | |
| 6,776,068 | B2 * | 8/2004 | Reuschel et al. | 81/54 |
| 6,820,628 | B2 | 11/2004 | Larson | |
| 6,840,503 | B2 | 1/2005 | Fortino | |
| 6,957,802 | B2 | 10/2005 | Fortino et al. | |
| 7,036,402 | B1 | 5/2006 | Marks et al. | |
| 7,118,091 | B2 * | 10/2006 | Price | 251/293 |
| 7,806,027 | B1 * | 10/2010 | Gao | 81/482 |
| 7,823,486 | B2 | 11/2010 | Wise | |

OTHER PUBLICATIONS

E.H. Wachs Company, "Pow-R-Drive II Valve Operator Model PRD II", Aug. 2002, p. 1-44, downloaded from www.ehwachs.com.
Singleton Equipment, Twister Mini & Supermini Operation and Maintenance Manual, Nov. 2008, p. 1-17, downloaded from http://pollardwater.com/pdf/pdf_web_manuals/ValveBoss_O-M_dmb.pdf.
Transmate, The Exerciser, Jul. 5, 2010, TM-25.

* cited by examiner

*Primary Examiner* — Monica Carter
*Assistant Examiner* — Danny Hong
(74) *Attorney, Agent, or Firm* — Shewchuk IP Services, LLC; Jeffrey D. Shewchuk

(57) ABSTRACT

A hand-held powered wrench includes a primary handle and a secondary handle. A motor is mounted on a primary handle. The secondary handle provides a second hand grip position which is significantly displaced from the primary handle axis, and includes a motor control for starting and stopping the motor. By having the significant displacement of the motor controlling second hand grip position, the operator naturally chooses a better stance and naturally dissociates the motor control hand from the torque sustaining hand in operation of the power wrench. The hand-held powered wrench can be used such as for safely exercising fire hydrant valves.

14 Claims, 3 Drawing Sheets

TWO HANDED PORTABLE POWER WRENCH

CROSS-REFERENCE TO RELATED APPLICATION(S)

None.

BACKGROUND OF THE INVENTION

The present invention relates to powered wrenches. In particular, the present invention pertains to portable powered wrenches that can be carried and applied with two hands at a variety of locations to provide torque, such as for exercising valves on fire hydrants. Such portable powered wrenches are often called valve testers or valve exercisers.

There are a wide variety of situations wherein wrenches are used to provide torque, such as to a nut or to the head of a bolt. The vast majority of these situations involve a relatively small hand-held tool intended for single handed operation, providing a moment arm on the tool totaling 18 inches or less from the axis of rotation. Some of these single handed tools also include a small motor for providing a turning force, so the wrench can rotate the subject without movement of the handle.

Some applications require more torque than a small, single-hand tool can readily deliver. For some of these larger applications, tools to provide torque are not hand-held, but rather are mounted on vehicles or stands. However, each use of such larger tools requires positioning of the vehicle or stand relative to the driven member, which can be difficult and time consuming. Vehicle or stand support structures also typically add considerable expense to the tool.

The present invention is directed to intermediate applications, where the torque required is significant but can still be applied by a portable handheld tool. A particular application where this is the case involves exercising of fire hydrant valves. Fire departments regularly exercise fire hydrant valves to ensure that the fire hydrants are operational should a need arise. Typically the torque required to open such valves has a peak in the range of 50-250 ft-lbs, and a full exercise involves five to twenty 360° rotations of the valve nut on the fire hydrant. While it is possible to perform these valve exercisings with a manually powered tool, the forces and repetitive stresses involved can lead to injuries of the workers. Accordingly, several companies have proposed solutions involving portable, hand-held, powered tools which can be used for exercising fire hydrant valves, such as Wm. F. Hurst Co., Inc. of Wichita, Kans., Singleton Equipment, LLC of Livingston, La. and E.H. Wachs Company of Harvard, Ill. The existing solutions have created problems of their own however and don't adequately consider operator safety, and better solutions are needed.

BRIEF SUMMARY OF THE INVENTION

The present invention is a hand-held powered wrench, such as used to exercise fire hydrant valves. A motor is mounted on a primary handle, which extends distally to a primary hand grip position. A secondary handle is mounted off the primary handle and provides a second hand grip position. The second hand grip position is significantly displaced from the primary handle axis, with a preferred angular displacement being 90° and a preferred position displacement being about 8 inches. The second hand grip includes a motor control for starting and stopping the motor. By having the significant displacement of the motor controlling second hand grip position, the operator naturally chooses a better stance and naturally dissociates the motor control hand from the torque sustaining hand in operation of the power wrench.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
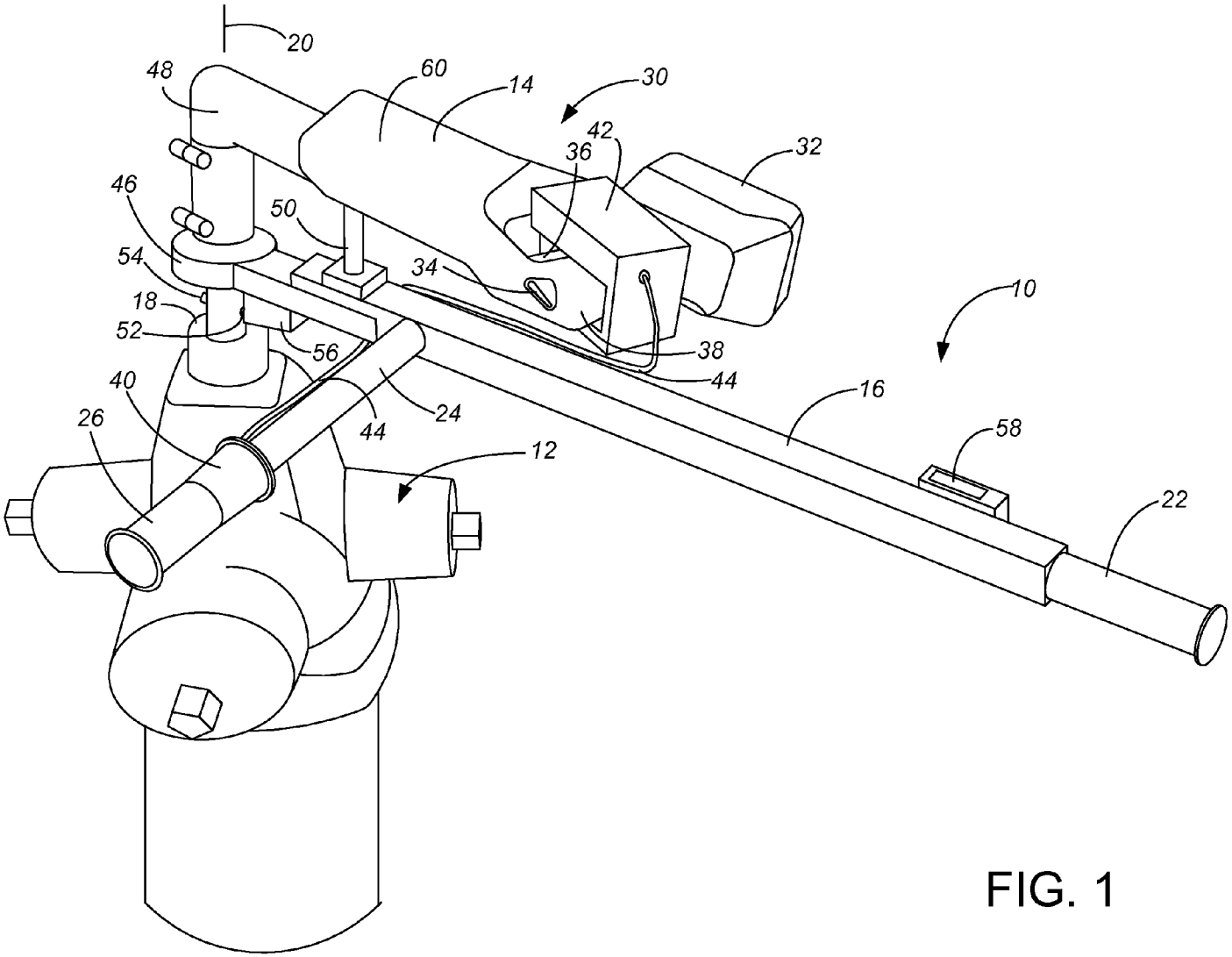
FIG. 1 is a perspective view of the preferred two-handed portable powered wrench of the present invention.

FIG. 1 shows a preferred embodiment of the two-handed portable powered wrench 10 of the present invention positioned in place relative to a fire hydrant 12, for flushing and gate valve turning (often called exercising) on the fire hydrant 12. The powered wrench 10 includes a motor 14 mounted on a primary handle 16 for delivering torque to a coupling head 18 about an axis of rotation 20. In general, the location/orientation of the axis of rotation 20 is determined by the location/orientation of the valve stem on the fire hydrant 12 being turned. The powered wrench 10 is portable in the sense that it can be hand carried and hand placed on the valve stem of the fire hydrant 12, without either setting up or placing any stand on the ground and without driving a vehicle (truck or cart) to a particular location relative to the fire hydrant 12. The wrench 10 is powered in that the motor 14 delivers torque relative to the primary handle 16, so the coupling head 18 (and valve stem) can be turned about the axis of rotation 20 while the primary handle 16 remains stationary. However, as the powered wrench 10 is used without a stand or vehicle, the operator must still provide an equal torque T to that applied by the powered wrench 10 to the valve stem in order to keep the primary handle 16 stationary, i.e, the operator must hold the handle 16 during use and keep it from spinning about the valve stem. The preferred powered wrench 10 delivers a substantial torque to the coupling head 18, such as 50 ft-lbs or more.

The primary handle 16 extends distally to a primary hand grip 22. A secondary handle 24 is mounted off a side of the primary handle 16 and extends to a second hand grip 26. In the preferred embodiment, the primary handle 16 is formed of a rectangular bar of solid aluminum, such as having a thickness of 1¼ inches and a width of 1½ inches. The primary handle 16 extends at least beyond the motor 14, and extends a significant distance such as 18 inches or more from the axis of rotation 20. The preferred primary handle 16 provides a primary hand grip 22 which is about four inches long, with the distal end of the primary hand grip 22 over 31 inches from the axis of rotation 20. With the primary hand on the hand grip 22, the user can hold the powered wrench 10 and apply up to about 250 ft-lbs of torque with a resistance force T of about 100 lbs or less. A different length of primary handle could be used to provide different amounts of maximum torque and/or different values of resistance force T required based upon different applications, but a maximum torque of about 250 ft-lbs and a corresponding resistance force T of about 100 lbs or less has been found appropriate for exercising of fire hydrant valves. The primary handle could alternatively be at a slightly different (non-right) angle relative to the axis of rotation or could alternatively be slightly out of alignment with the axis of rotation, so long as the deviation from a right angle or the offset from the primary handle axis to the axis of rotation was sufficiently small that the vast majority (i.e., 85% or more) of force placed normal to the primary handle results in a torque component about the axis of rotation, and the term "substantially intersects the axis of rotation at a right angle" is intended to include such a slight deviation.

Figure 2:
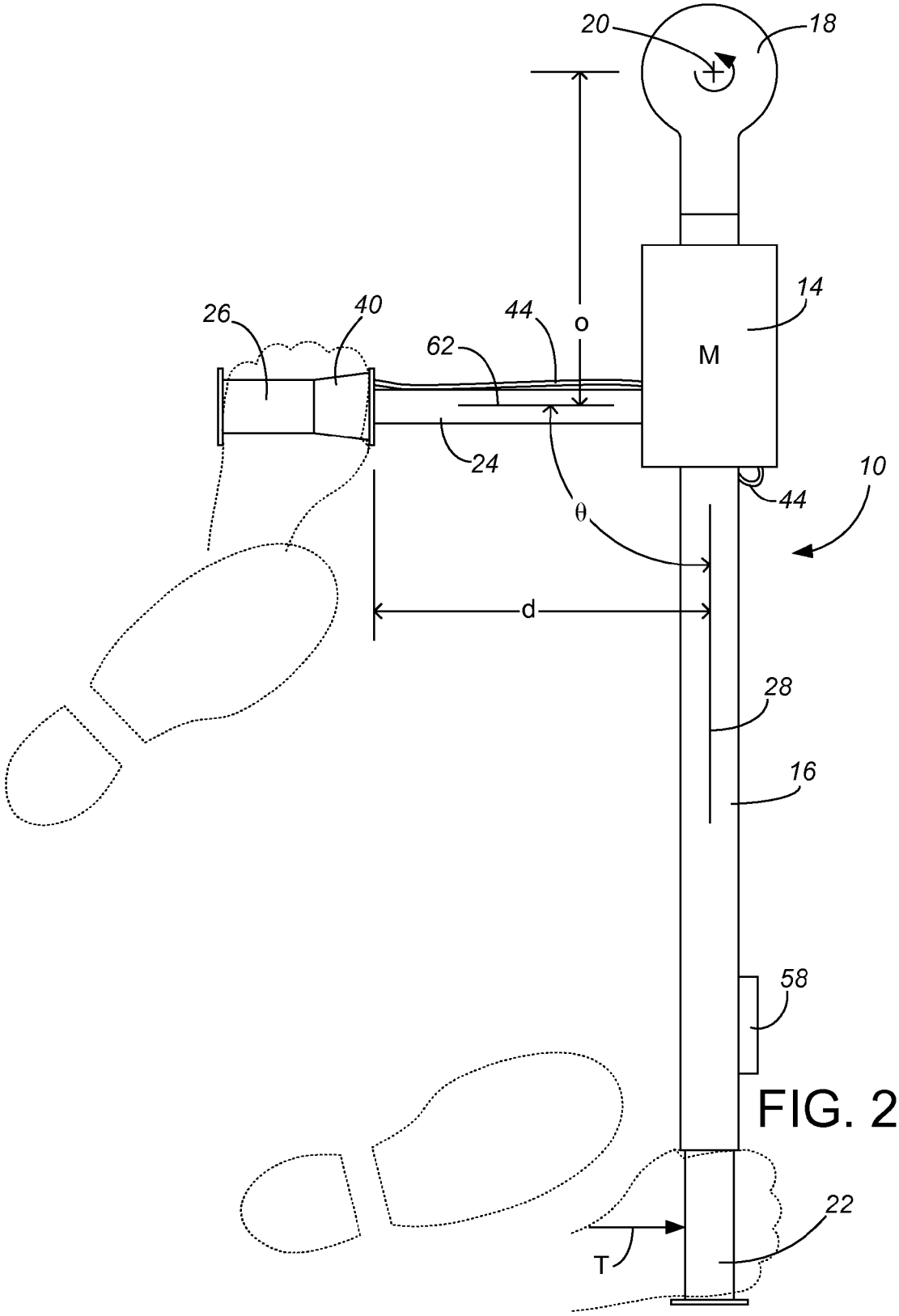
FIG. 2 is a schematic top plan view showing use of the powered wrench of FIG. 1.

The secondary handle 24 provides a second hand grip 26 which is about four inches long, with the distal end of the second hand grip 26 about 12¾ inches from the center line 28 (called out in FIG. 2) of the primary handle 16. In the preferred embodiment, the secondary handle 24 is provided by a cylindrical bar of solid aluminum, such as a diameter of ⅞ inch. The secondary handle 24 is preferably threadingly received on either the left side (as shown in FIGS. 1 and 2) or the right side (not shown) of the primary handle 16, resulting in either left or right hand torque control. The purpose of the secondary handle 24 is to provide a location for hand control of the motor 14 and to stabilize—but provide little or no torque force—the powered wrench 10 during use. Accordingly, the secondary handle 24 could be placed anywhere along the primary handle 16 for a convenient hand position. By placing the secondary handle 24 in a central position and away from either end of the primary handle 16 (i.e., proximal to the primary hand grip position and at least 4 inches from the axis of rotation 20), the secondary handle 24 is clearly distinguished in the mind of the operator from a torque sustaining position. In the preferred embodiment, the secondary handle 24 is located closer to the axis of rotation 20 than to the distal end of the primary handle 16, such as with an offset o (called out in FIG. 2) of about 8 inches from the axis of rotation 20 and about 23 inches from the distal end of the primary handle 16. The preferred embodiment further positions the secondary handle 24 in the same horizontal plane as the primary handle 16 relative to a vertical axis of rotation 20. These locations and lengths place the centers of the primary hand grip 22 and the second hand grip 26 about 24 inches apart, which has been found to be a comfortable distance between hand grip locations for holding the powered wrench 10 during use. A wide variation between hand grip positions is alternatively possible to provide comfortable hand grip locations for any particular application of the powered wrench 10. Both the primary hand grip 22 and the second hand grip 26 may include a rubber sleeve (not separately shown) or other soft durometer outer material to further increase comfort on the operator's hands.

In the preferred embodiment, the motor 14 is provided by a right angle drill assembly 30 powered by a rechargeable battery 32. The direction of the motor 14 can be reversed by a convenient switch 34, so the powered wrench 10 can be used for both opening and closing the fire hydrant valve. The drill 30 is mounted such that it extends substantially horizontally over the primary handle 16. While other orientations could be used for the motor (such as in line with the axis of rotation 20, or to the side or of under the primary handle 16), using a generally horizontal orientation of the drill 30 over the primary handle 16 leads to a smaller overall size, a simpler drive train, and a more natural, compact feel to the powered wrench 10. The preferred right angle drill 30 depicted in FIG. 1 is commercially available from Milwaukee Electric Tool Corporation of Brookfield, Wis. as a model 0721-21 28V right angle drill powered by a rechargeable lithium-ion battery and driving a ½ inch output shaft. This preferred right angle drill 30 is a variable speed drill which can deliver a maximum torque of about 1000 in-lbs and a maximum speed of about 1000 rpm (with a full battery charge). The right angle drill 30 is just over 18 inches long, and weighs just over 10 lbs. The preferred drill 30 is mounted so its rechargeable battery 32 is accessible to be easily removed, recharged and replaced. A wide variety of other hand held power drills could alternatively be used to provide the motor 14, including those powered pneumatically and powered by a corded electrical connection (such as off of 120V AC or 220V AC commonly provided in the U.S.). Choosing a commercially available drill motor to drive the powered wrench 10 helps to reduce the cost of a small production run, but it is noted that outfitting a dedicated use motor might be more economical for larger production runs of powered wrenches.

The preferred motor 14 is controlled by a variable speed trigger 36 on the provided drill handle 38. However, the trigger 36 is not in the ideal position obtained by the present invention, which instead controls the variable speed of the motor 14 by a motor control 40 provided at the second hand grip position. The preferred motor control 40 is a rotational control, such as provided by a grip twist shift commercially available from SRAM, LLC of Chicago, Ill. A mechanical trigger depression box 42 is assembled around the drill trigger 36, and a cable 44 is used to transfer the twisting of the motor control 40 into a pulling of the trigger 36 in an amount proportional to the amount of twist. Many alternative mechanisms could be used to transfer the motor control provided at the second hand grip position to whatever location needed by the motor 14. For instance, the control could be provided electrically (such as by opening up the trigger mechanism on the preferred drill 30 and wiring directly to the electrical connections therein) by an electrical switch, or could be provided by a different mechanical arrangement, such as by a lever control of a cable or by a different linkage. However, the preferred twist shift control 40 provides a clean appearance and provides a mechanical control which is unlikely to be accidentally engaged during handling, storage and transportation of the powered wrench 10. The preferred twist shift control 40 also inherently signals to the operator that the control hand is different from the torque hand and that the control hand is not intended to provide the torque force necessary to hold the powered wrench 10 stationary. Further, because the control of the drill motor 14 is provided without modification of the drill 30 itself, the drill 30 can be disengaged from the primary handle 16 and separately used if desired. For example, the remainder of the powered wrench can be sold separately from the drill and have a wide range of drill attachment structures, permitting the owner to separate obtain the drill and attach and detach whichever model of drill the owner has.

To increase the torque supplied by the preferred motor 14, the right angle output of the drill 30 is received in a gear reduction/torque multiplier mechanism 46. The preferred gear reduction is provided by a 33:1 torque multiplier 46 from Pittsburgh Automotive of Camarillo, Calif. under model number 93645, but modified to increase the strength of the housing and double eccentric shaft. The torque multiplier 46 is important not only because it increases the torque available from the drill 30, but also because it transfers the majority of the torque directly to the primary handle 16, and thus the right angle drive 48 and the hardware attaching the drill 30 to the primary handle 16 doesn't have to withstand the full force of turning the output coupling head 18. The preferred drill 30 is mounted on the primary handle 16 using an attachment pillar 50. The attachment pillar 50 has a male threaded end which is sized to mate with the threads of the side handle holes on the preferred drill 30. With a 33:1 torque multiplier 46, approximately 97% of the torque required to turn the output socket 18 is transferred directly to the primary handle 16, with only about 3% of the torque transferred to the primary handle 16 through the right angle drive 48 and attachment pillar 50. Additionally, the 33:1 torque multiplier 46 reduces the rotational speed of the drill 30 by 33 times, giving much greater feel and control to the operator when rotating the valve stem, such that in operation the valve turning speed peaks at about 15-30 rpm, which is an appropriate speed for exercising fire hydrant valves.

The socket head 18 which mates with the output of the torque multiplier 46 is attached to the output shaft using a shear pin 52 of about ¼ inch diameter. The preferred shear pin 52 is designed to shear at 250 ft-lbs of torque (250 lbs at two locations on a 1 inch drive), which is significantly less than the peak torque available from the preferred drill 30 through the preferred torque multiplier 46. Limiting the torque output of the powered wrench 10 not only helps to avoid damage to any of the components and damage to the fire hydrant valves due to excessive torque (because the shear pin 52 fails prior to such damage), but also prevents injury to the operator by limiting the force which can be applied by the powered wrench 10. In the preferred arrangement, the shear pin 52 is magnetically held into the socket 18 and through the output shaft with a magnet 54.

The magnet 54 projects on the outside of the socket 18. As the socket 18 rotates, the magnet 54 mechanically closes a switch 56 once for each rotation. The switch 56 is wired into a rotation counter 58, with the wire (not shown) running along the bottom of the primary handle 16. The rotation counter 58 is mounted in an easily readable location, such as on a distal side of the primary handle 16. The preferred rotation counter 58 is a model H7EC counter commercially available from Omron Corporation of Kyoto, Japan.

One of the most important aspects of the powered wrench 10 is the result of the natural hand positions that are used, leading to a usage which is both intuitive and engineered to minimize the likelihood of user injury and fatigue. When carrying the powered wrench 10, the bulk of the weight of the powered wrench 10 is provided by the drill 30. While either handle 16, 24 could be used to carry the powered wrench 10, the most natural place to carry the powered wrench 10 is by the body 60 of the drill 30, with a second hand optionally on the primary handle 16. In other words, the natural carrying position is well away from the control mechanism 40, and the likelihood of inadvertent operation of the motor 14 is very small.

When the operator arrives at the hydrant 12 to be exercised, the first step is to place the socket 18 on the valve stem. The weight of the motor 14, coupled with its offset position relative to the locations of the two hand grips 22, 26, means that the operator will naturally hold the body 60 of the drill 30 to position the powered wrench 10 onto the valve stem. Most importantly, while placing the socket 18 on the valve stem, there is essentially no possibility of inadvertent operation of the motor 14, and the risk of the handle 16 spinning uncontrolled (and the possibility of injury caused thereby) is essentially eliminated. Once on the valve stem, the socket 18 itself can support the entire weight of the powered wrench 10 without falling off the valve stem. The operator then next moves one hand (the operator's right hand in the arrangement shown in FIG. 1) to the most obvious, most extended location, i.e., to the primary hand grip 22, raising the primary hand grip 22 to a comfortable working position. The primary hand grip 22 is naturally, intuitively and physically the location to best withstand the torque of the powered wrench 10. Only after the primary hand grip 22 is securely in hand does the natural proceeding of the operator move to grasping the second hand grip 26 with the other hand.

Figure 3:
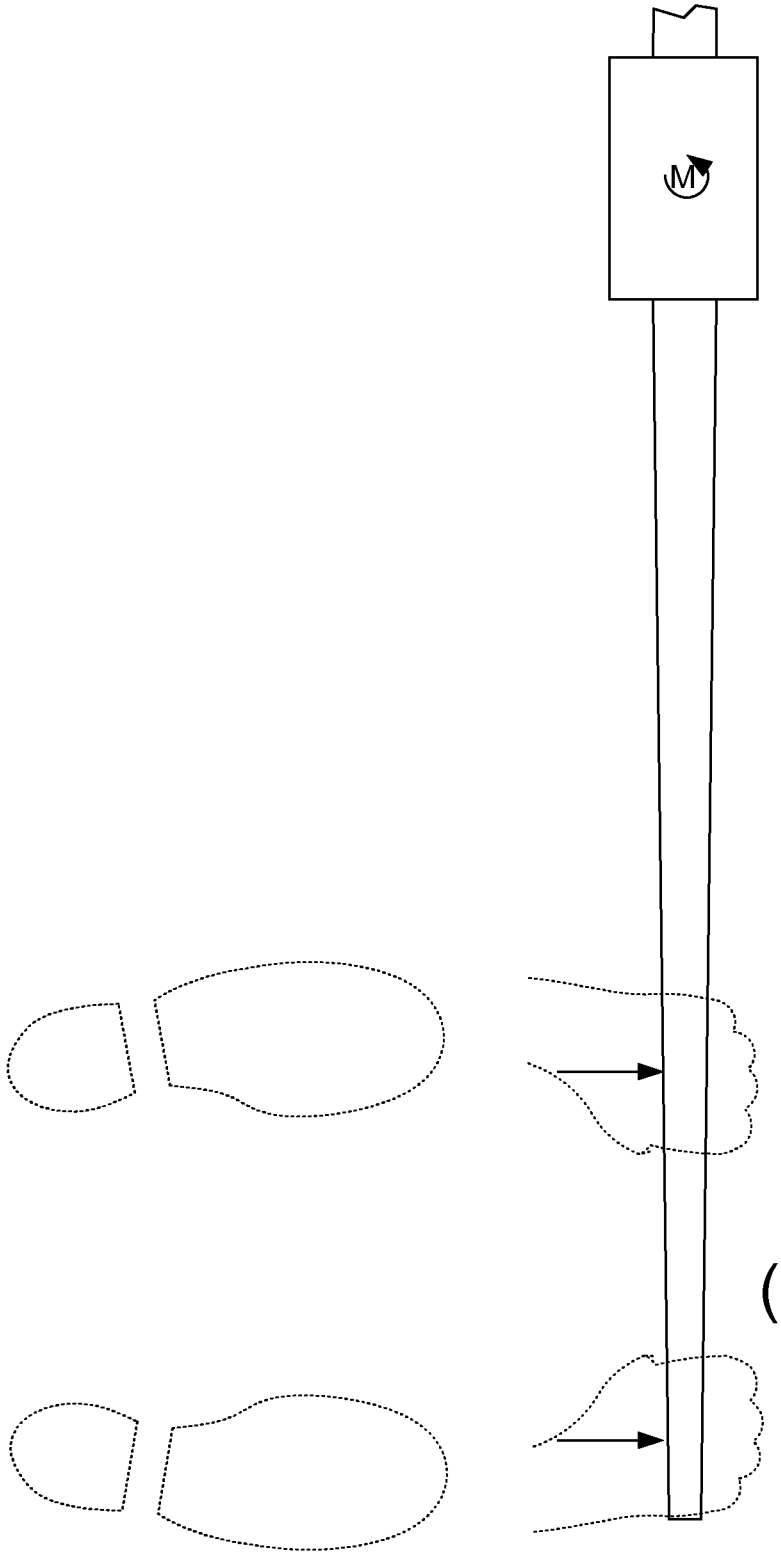
FIG. 3 (Prior Art)
FIG. 3 is a schematic top plan view showing use of a prior art powered wrench.

The position of the second hand grip 26 relative to the primary hand grip 22 naturally and intuitively results in a change in the operator's handling position relative to the prior art, best shown with reference to FIGS. 2 and 3. Namely, the second hand grip position is significantly displaced from the primary handle axis 28 in one or both of angle θ and position d. "Significantly displaced", as used in this application, can be functionally thought of as being sufficiently out of alignment with the primary handle axis so as to inherently signal to the operator an important distinction between hands, i.e., that one hand is intended to withstand the majority or totality of the torque of the powered wrench 10, while the other hand is intended to control the torque output of the motor 14. As shown in FIG. 2, the second hand grip 26 is significantly displaced in position d from the primary handle axis 28 by being four or more inches away from the primary handle axis 28. In the preferred embodiment, the entirety of the second hand grip 26 is over eight inches displaced from the primary handle axis 28. As shown in FIG. 2, the second hand grip 26 is significantly displaced in angle θ from the primary handle axis 28 by being 30° or more away from the primary handle axis. In the preferred embodiment, the second hand grip 26 is 90° displaced from the primary handle axis 28.

Additionally, in contrast to the primary handle axis 28 which substantially intersects the axis of rotation 20 at around a right angle, the displacement causes the axis 62 of the second hand grip 26 to extend perceptibly away from the axis of rotation 20 such as by the offset o. The significant displacement causes the operator to inherently know that the hand placed on the primary hand grip 22 will be the torque-sustaining hand, while the hand placed on the second hand grip 26 will be the control hand. The relative size difference between the larger primary handle 16 and the smaller diameter secondary handle 24 further reinforces in the operator's mind the different functions of the two hands.

This significant displacement of the present invention is in stark contrast to the prior art positions, such as taught by U.S. Pat. No. 6,776,068, wherein both hand positions are on the primary handle axis. While the structure of U.S. Pat. No. 6,776,068 teaches a foot pedal control, the present invention involves more than merely changing control of the motor from a foot pedal (which itself is likely to lead to an off-balance position of the operator) to a hand control. If both hands are in significant alignment with the primary handle axis, the present inventor has identified two effects which lead to a dangerous situation.

One effect is that the operator's natural feet position, which is with both feet side by side in line with the handle, in something of a waterskiing position as shown in FIG. 3. In other words, the inherent feet position inspired by the hand positions of the prior art is also the feet position which is least able to withstand the torque direction. Operators, particularly new or inexperienced operators, can be easily pushed or pulled off balance when hit with the torque force. Obviously, once operators become sufficiently experienced with a tool to anticipate the torque force, they can readjust their foot position closer to those of the operators shown in U.S. Pat. No. 6,776,068, but the present invention is in part directed to the induced foot position naturally caused merely by the handle locations, without regard for how experienced operators can overcome and replace their natural foot position tendencies.

In contrast, the present invention leads the operator to naturally and intuitively place his or her feet in a much more balanced and better position, shown in FIG. 2, to withstand the torque moments when operating the powered wrench 10. The wide handle location induces a natural spreading of the feet. The angular or offset position of control handle location tends to pull the operator's left foot position away from the primary handle 16, more into a "surfing" foot position than a "waterskiing" foot position. This spread and positioning of the operator's feet naturally places the operator in a better stance to withstand the up to 100 lbs of torque force T, which is withstood largely as a weight shift from one foot to the other rather than merely a rocking backward of both feet equally. Injury and fatigue are less likely to occur.

Separate from the danger of being knocked off balance, the natural tendency of the operator when battling against the torque moments is to tighten his or her grip on the primary handle 16. When operating a variable speed motor, this is typically the exact opposite reaction as desired for safety purposes. In other words, when the torque force T is the strongest or the operator is most off balanced, a hand control on the primary handle axis would induce the operator to increase, and not decrease, the torque force, spiraling into a more and more dangerous situation, either as the handle spins out of control or the operator is hit or pulled over by the handle. In contrast, the present invention leads the operator to mentally separate between one hand for absorbing the torque force T and a separate hand for controlling motor torque. Because of the significant displacement between the two hands, the operator much more naturally and intuitively reduces torque on the power control hand while tightening grip on the torque-withstanding hand, best reacting to avoid a dangerous situation. The present invention thus leads to a powered wrench 10 with a much lower likelihood of workplace injury as compared to the prior art.

Further, by positioning the second hand grip 26 away from the motor 14, the second hand grip position easily provides stability to the powered wrench 10 while in use, while at the same time the bulk of the weight of the drill 30 is supported by the valve stem. Operators are not fatigued by either having to grip the powered wrench 10 tightly to prevent rotation about the handle axis or by having to lift the weight of the drill 30 during rotation. A typical valve opening or closing can be accomplished in 10 to 30 seconds with little strain on the operator, and with a substantially eliminated risk of injury.

Although the present invention has been described with reference to preferred embodiments, workers skilled in the art will recognize that changes may be made in form and detail without departing from the spirit and scope of the invention. For instance, while the preferred powered wrench 10 is particularly contemplated and designed for fire hydrant valve exercising, it can be easily used for other valves, including using extensions to turn underground valve stems. The preferred powered wrench 10 can be outfitted with other coupling heads to be used for other purposes, and can be readily modified for an even wider range of uses.

What is claimed is:

1. A hand-held powered wrench, comprising:

a motor for providing rotational torque about an axis of rotation to a coupling head;

a primary handle supporting the motor in a stationary position relative to the primary handle, the primary handle extending to a primary hand grip position at least 18 inches from the axis of rotation to withstand peak torque delivered by the motor, the primary hand grip position defining a primary handle axis which substantially intersects the axis of rotation at a right angle;

a secondary handle mounted off the primary handle and providing a second hand grip position, the second hand grip position being significantly displaced from the primary handle axis in one or both of angle and position; and a motor control supported on the secondary handle so as to be accessible by a hand in the second hand grip position.

2. The hand-held powered wrench of claim 1, wherein the coupling head is a socket head sized for turning a fire hydrant valve.

3. The hand-held powered wrench of claim 1, wherein the second hand grip position defines a second hand axis which is at an angle of at least 30° relative to the primary handle axis, and wherein the second hand grip position is at least 4 inches from the axis of rotation.

4. The hand-held powered wrench of claim 3, wherein the second hand grip position defines a second hand axis which is substantially orthogonal relative to the primary handle axis.

5. The hand-held powered wrench of claim 4, wherein, when the axis of rotation extends substantially vertically, the primary handle axis and the second hand axis both extend substantially horizontally.

6. The hand-held powered wrench of claim 1, wherein the entirety of the second hand grip position is at least four inches away from the primary handle axis.

7. The hand-held powered wrench of claim 1, wherein, with a vertically oriented axis of rotation, the motor is mounted vertically over the primary handle.

8. The hand-held powered wrench of claim 1, wherein the motor is a variable speed motor, wherein the second hand grip position defines a second hand axis, and wherein the motor control is a grip rotatable about the second hand axis.

9. The hand-held powered wrench of claim 1, wherein the primary handle is a solid aluminum bar.

10. The hand-held powered wrench of claim 1, further comprising a gear reduction unit between the motor and the coupling head, and such that motor and the gear reduction unit of the hand-held powered wrench can deliver at least 50 ft-lbs of torque.

11. The hand-held powered wrench of claim 1, wherein the motor is positioned relative to the primary hand grip position and the second hand grip position such that, with hand-held powered wrench being held at the primary hand grip position and the second hand grip position with the axis of rotation extending vertically, the weight of the motor is substantially displaced from both the primary hand grip position and the second hand grip position and bourn by the coupling head.

12. The hand-held powered wrench of claim 11, wherein the motor is a hand-held drill disposed substantially parallel to and over the primary handle, with the output of the hand-held drill being coupled through a right angle drive so the axis of rotation extends vertically.

13. A handle arrangement for a hand-held powered wrench, comprising:

a primary handle having a detachable connection adapted to support a motor in a stationary position relative to the primary handle, the primary handle extending to a primary hand grip position, the primary hand grip position defining a primary handle axis;

a gear reduction unit supported by the primary unit for connection with the detachable motor, an output drive shaft of the gear reduction unit defining an axis of rotation substantially intersecting the primary handle axis at a right angle, with the axis of rotation positioned at least 18 inches from the primary hand grip position;

a secondary handle mounted off the primary handle and providing a second hand grip position, the second hand grip position being significantly displaced from the primary handle axis in one or both of angle and position; and a motor control supported on the secondary handle so as to be accessible by a hand in the second hand grip position.

14. The handle arrangement of claim 13, wherein the detachable connection is a pillar having a male threaded end to be received in a female threaded hole on the detachable motor.

* * * * *